United States Patent [19]

Oyama et al.

[11] 4,339,756

[45] Jul. 13, 1982

[54] ANTENNA EQUIPMENT OF UHF TUNER

[75] Inventors: Kohei Oyama, Soma; Eiji Nishizawa, Kakuda, both of Japan

[73] Assignee: Alps Electric Co. Ltd., Tokyo, Japan

[21] Appl. No.: 242,366

[22] Filed: Mar. 10, 1981

[30] Foreign Application Priority Data

Nov. 3, 1980 [JP] Japan ..... 55-30484
Nov. 4, 1980 [JP] Japan ..... 55-48848[U]

[51] Int. Cl.[3] ..... H01Q 1/24
[52] U.S. Cl. ..... 343/702; 343/720
[58] Field of Search ..... 343/702, 848, 849, 850, 343/851, 749, 720

[56] References Cited

U.S. PATENT DOCUMENTS 4,025,856 5/1977 Sode ..... 343/702

FOREIGN PATENT DOCUMENTS 4488778 10/1978 Japan .

*Primary Examiner*—David K. Moore
*Attorney, Agent, or Firm*—Guy W. Shoup; Gerard F. Dunne

[57] ABSTRACT

An antenna equipment of a UHF tuner characterized in that a supporting portion of an insulator to which antenna pins are fastened is mounted on a tuner chassis, and that an antenna coil connected to the antenna pins is located inside the tuner chassis, whereas a resistor connected to the antenna pin and the tuner chassis is disposed outside the tuner chassis.

5 Claims, 8 Drawing Figures

ANTENNA EQUIPMENT OF UHF TUNER

BACKGROUND OF THE INVENTION

The present invention relates to antenna equipment fixed to the chassis of a UHF tuner.

In general, antenna equipment of this type is constructed of two antenna pins, a single fixed resistor, and supporting members for supporting these elements. It is mounted so that the parts other than the fore ends of the two antenna pins may lie inside the chassis of the UHF tuner.

With such antenna equipment of the UHF tuner, the volume occupied in the chassis by the internal elements is large because most parts of the equipment are disposed therein. Recently, UHF tuners are made from a hybrid IC and the circuit density thereof is thus made high, so that the chassis becomes very small in size. Accordingly, miniaturization of the antenna equipment is desired.

SUMMARY OF THE INVENTION

The present invention has for its object to provide antenna equipment which is suitable for use in a small-sized UHF tuner.

Another object of the present invention is to provide antenna equipment wherein an antenna coil inside a chassis can be adjusted readily.

Still another object of the present invention is to provide antenna equipment which can enhance the job efficiency in a process for assembling a UHF tuner.

The present invention for accomplishing the objects comprises a fixed resistor of the antenna equipment being mounted on the outer wall of a tuner chassis. Further objects and advantages of the present invention will become more apparent from the following detailed description taken with reference to the drawings.

PREFERRED EMBODIMENTS OF THE INVENTION

Now, the present invention will be described in conjunction with an embodiment illustrated in FIGS. 1 to 4. Numeral 11 designates an antenna terminal box (support) made from an insulator. The antenna terminal box

Figure 1:
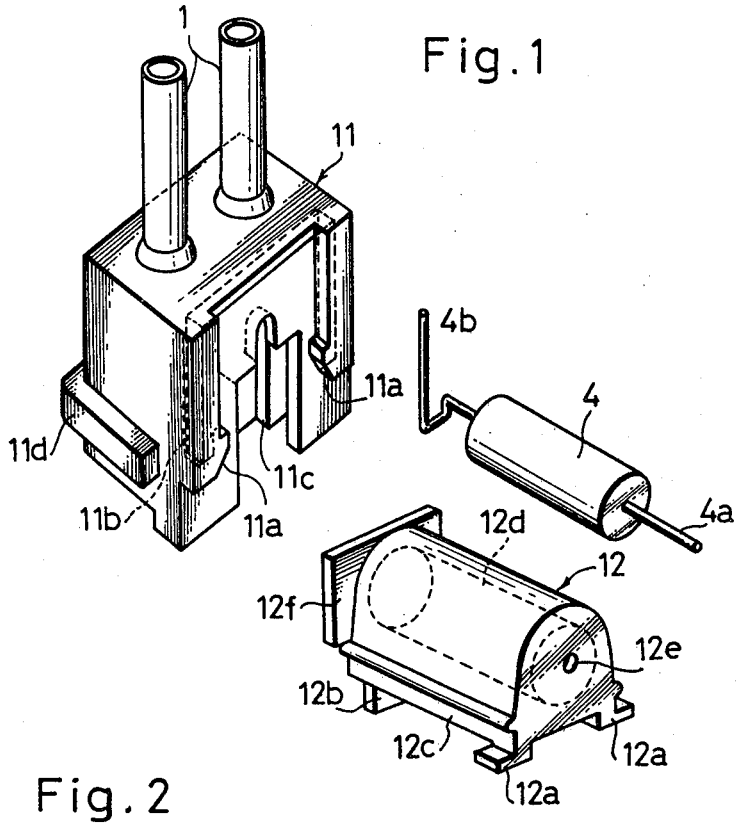
FIG. 1 is an exploded perspective view of an embodiment of an antenna equipment according to the present invention.
Figure 2:
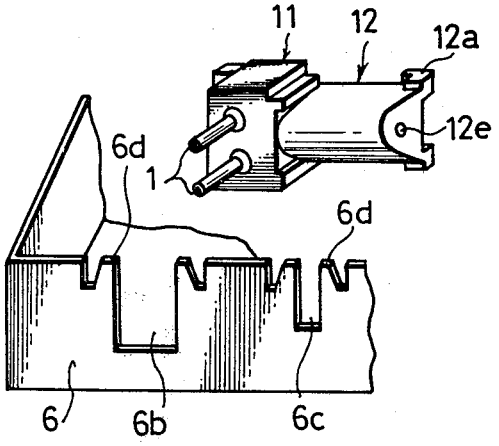
FIG. 2 is a view for explaining how the antenna equipment shown in FIG. 1 may be fixed to a tuner chassis.
Figure 3:
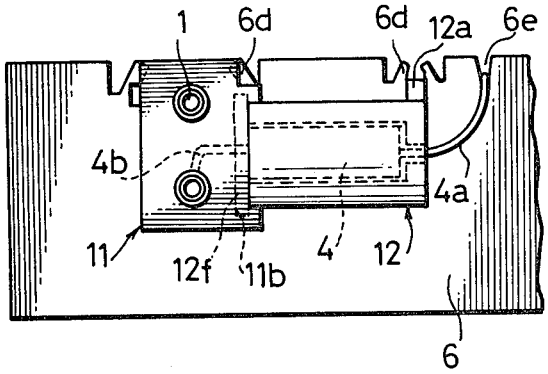
FIG. 3 is a side view showing the antenna equipment according to the present invention fixed to the tuner chassis.
Figure 4:
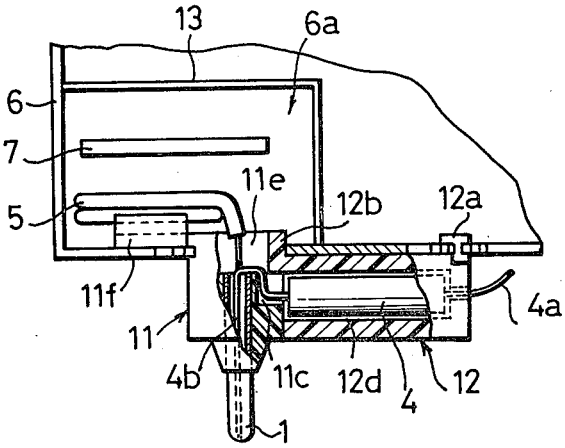
FIG. 4 is a sectional top view showing the state in FIG. 3.
Figure 5:
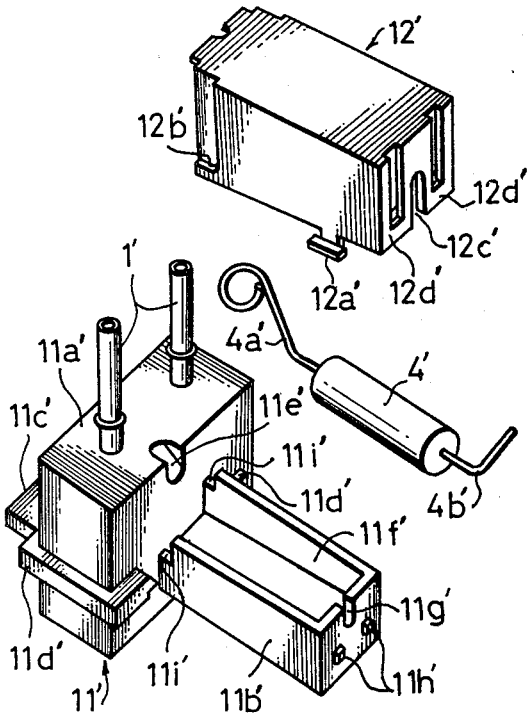
FIG. 5 is an exploded perspective view of another embodiment of the antenna equipment according to the present invention.
Figure 6:
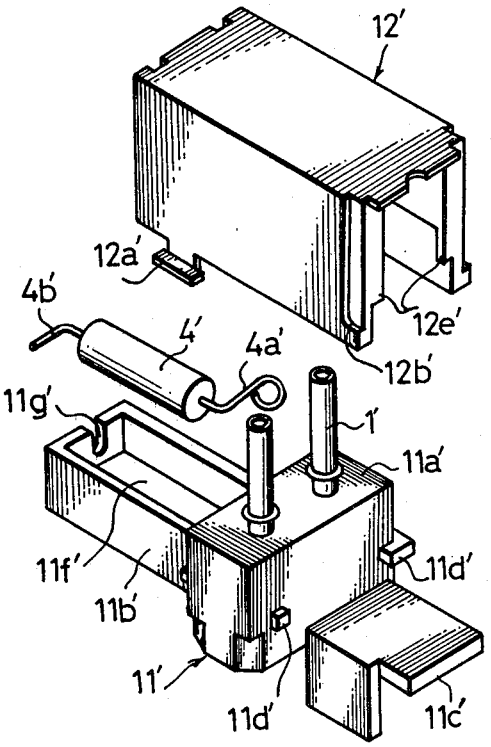
FIG. 6 is an exploded perspective view in which the state shown in FIG. 5 is seen from the opposite side.
Figure 7:
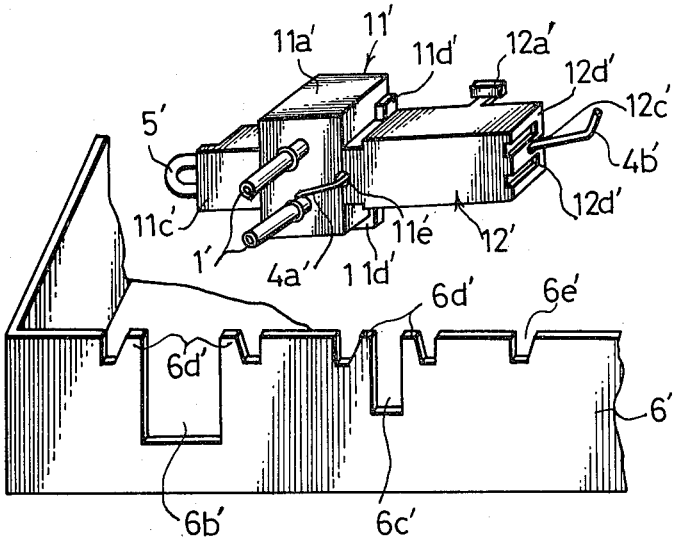
FIG. 7 is a view for explaining the situation in which the antenna equipment shown in FIGS. 5 and 6 is fixed to a tuner chassis.

11 is provided with pawls 11*a* which are formed on a side surface, a case fitting groove 11*b* which is formed behind the engaging pawls 11*a*, a recess 11*c* which is formed behind the fitting groove 11*b*, an engaging protuberance 11*d* which is formed on side surfaces, holes 11*e* which, as shown in FIG. 4, are formed as a continuation of the recess 11*c*, and a receiver 11*f* on which an antenna coil 5 is placed. Antenna pins 1 and 1 are fastened to the antenna terminal box 11 in a manner to jut out through the holes 11*e*.

Numeral 12 designates a case made from an insulator. The case 12 is provided with narrow legs 12*a*, a broad leg 12*b*, a pair of protrusive strips 12*c* which are formed on opposing side surfaces, a hollow 12*d* which serves to receive a protective resistor 4, an aperture 12*e* which serves to lead out a lead wire 4*a* of the resistor 4, and a plate portion 12*f* which lies on the side opposite to the aperture 12*e*.

Now, the assemblage between the antenna terminal box 11 and the case 12 will be described. First, the resistor 4 is put into the hollow 12*d* of the case 12 and the lead wire 4*a* is led out through the aperture 12*e*. Thus, the resistor 4 is received in the hollow 12*d*.

Subsequently, the plate portion 12*f* of the case 12 is set in the fitting groove 11*b* of the antenna terminal box 11, and a lead wire 4*b* of the resistor 4 is set in the pin 1, whereby the case 12 and the antenna terminal box 11 are fitted. Then, the plate portion 12*f* is snugly fitted in the fitting groove 11*b*, and the antenna terminal box 11 and the case 12 are combined.

At this time, the engaging pawls 11*a* of the antenna terminal box 11 engage the lower part of the case 12 so as to prevent the case from falling from engagement with the box 11. The protrusive strips 12*c* of the case 12 align with the engaging protuberance 11*d* of the antenna terminal box 11. In addition, the lead wire 4*b* of the resistor 4 enters the recess 11*c* of the antenna terminal box 11 and is inserted in the pin 1.

At the next step, the antenna coil 5 is placed on the receiver 11*f* of the antenna terminal box 11, and both the end parts of the coil 5 are inserted into the pins 1. Under this state, solder is poured into the pins 1 to connect the coil 5 and the resistor 4 to the pins 1, and the antenna equipment is completed.

The antenna equipment is mounted on a tuner chassis 6. This assemblage will be described with reference to FIGS. 2 to 4. The tuner chassis 6 is provided with a window 6*b* for locating the antenna terminal box 11 open at one end, a slot 6*c* for locating the legs 12*a* of the case 12, bendable pieces 6*d* and a notch 6*e*. The antenna terminal box 11 is inserted into the window 6*b* in the state under which the coil 5 and the receiver 11*f* are located in the interior 6*a* of the chassis 6. The legs 12*a* of the case 12 are inserted into the slot 6*c* in the state under which the body of the case 12 is located outside the chassis 6.

Subsequently, the bendable pieces 6*d* of the chassis 6 are bent to hold the antenna terminal box 11 and the case 12 to the chassis 6. The lead wire 4*a* of the resistor 4 is fitted in the notch 6*e* of the chassis 6 and is soldered to complete the assemblage.

In the assembled state, the interior 6*a* defined by a partition wall 13 may be small and compact as shown in FIG. 4.

Now, another embodiment of the present invention will be described with reference to FIGS. 5 to 8. 11' indicates an antenna terminal box made from an insulator. The antenna terminal box 11' is provided with a base portion 11a' to which antenna pins 1' and 1' are fastened, a holder portion 11b' which is formed unitarily with the base portion 11a' and which serves to hold a resistor 4', and a receiver portion 11c' which is formed unitarily with the base portion 11a' and which serves to place an antenna coil 5'.

The base portion 11a' of the antenna terminal box 11' is formed with a protuberance 11d' at its periphery, and a recess 11e' at its upper end. Further, the holder portion 11b' is formed with a receiving portion 11f' in its central part and a slot 11g' and engaging bulges 11h' at its one end.

12' indicates a cover made from an insulator. The cover 12' is provided with legs 12a' at lower parts, steps 12b' at one end, and a groove 12c' and engaging pieces 12d' at the other end.

Now, the assemblage between the antenna terminal box 11' and the cover 12' will be described. First, one lead wire 4a' of the resistor 4' is twined round one antenna pin 1' and is located in the recess 11e'. The other lead 4b' is located in the slot 11g' of the holder portion 11b'. Under this state, the resistor 4' is put in the receiving portion 11f' of the holder portion 11b'.

Next, the cover 12' is combined with the antenna terminal box 11' so as to cover the resistor 4' and the holder portion 11b'.

In the combination, first of all, projections 12e' provided inside the cover 12' are fitted on notches 11i' of the holder portion 11b', and the engaging pieces 12d' of the cover 12' are brought to that side wall of the holder portion 11b' which is provided with the engaging bulges 11h'. Under this state, the cover 12' is depressed. Then, the cover 12' has its engaging pieces 12d' brought into engagement with the engaging bulges 11h' of the holder portion 11b' and has an end of the protuberance 11d' of the antenna terminal box 11' brought into engagement with its step 12b', whereby both the components 11' and 12' are combined. At this time, the other lead wire 4b' of the resistor 4' is located in the groove 12c' of the cover 12'.

Figure 8:
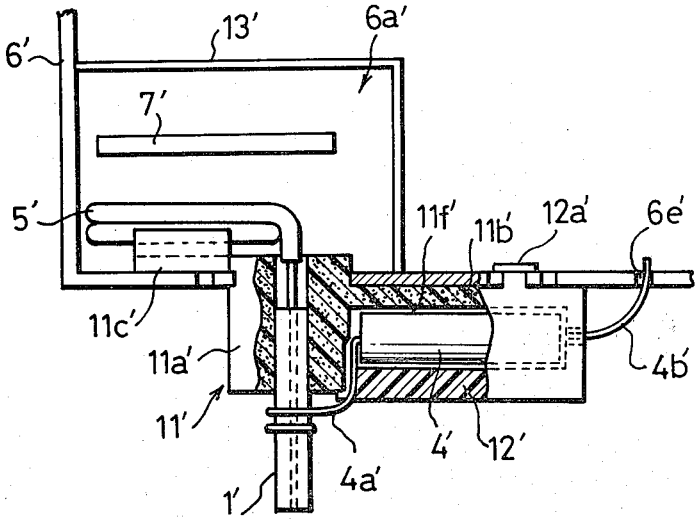
FIG. 8 is a sectional top view showing the state in which the antenna equipment according to the present invention has been fixed to the tuner chassis.

The antenna coil 5' is attached to the antenna terminal box 11' on which the resistor 4' and the cover 12' have been mounted. In the attachment, as illustrated in FIG. 8, both end parts of the antenna coil 5' are inserted through the antenna pins 1' and 1', and the body portion of the antenna coil 5' is placed on the receiver portion 11c' of the antenna terminal box 11', whereupon both the end parts of the antenna coil 5' are soldered to the antenna pins 1' and 1'. Further, the lead wire 4a' of the resistor 4' twined round one antenna pin 1' is soldered to the antenna pin 1' to complete assembly.

The antenna equipment is mounted on a tuner chassis 6'. This assemblage will be described with reference to FIGS. 7 and 8. The tuner chassis 6' is provided with a window 6b' for locating the antenna terminal box 11' open at one end, a slot 6c' for locating the legs 12a' of the cover 12', bendable pieces 6d' and a notch 6e'. The base portion 11a' of the antenna terminal box 11' and the legs 12a' of the cover 12' are respectively located in the window 6b' and the slot 6c', and the bendable pieces 6d' are bent to hold the base portion 11a' and the legs 12a'. Then, the antenna equipment is mounted on the tuner chassis 6' (refer to FIG. 8).

When the antenna equipment has been mounted on the tuner chassis 6' in this manner, as seen from FIG. 8 the antenna coil 5' and the receiver portion 11c' lie in the interior 6a' of the tuner chassis 6' defined by a partition wall 13', whereas the holder portion 11b', the resistor 4' and the cover 12' lie outside the tuner chassis 6'. The other lead wire 4b' of the resistor 4' is located in the notch 6e' of the tuner chassis 6' and is soldered. Then, the mounting of the antenna equipment on the tuner chassis 6' is completed.

What is claimed is:

1. An antenna equipment for a UHF tuner, comprising:

a supporting member made from an insulator and adapted to be fixed to a wall of a chassis of the UHF tuner, two antenna pins fastened to said supporting member, each of said two antenna pins having its one end protruded outwardly of said supporting member and its base end part exposed in the chassis side of said UHF tuner;

an antenna coil arranged inside said UHF tuner and electrically coupled with the base end parts of said antenna pins through an opening formed in said UHF tuner;

a fixed resistor arranged on the outer wall of said chassis of said UHF tuner, one of the two leads of said resistor being electrically connected to either of said two antenna pins and the other of said two leads being electrically connected to said chassis of said UHF tuner; and a cover member made from an insulator and adapted to be fixed to said wall of said chassis of said UHF tuner and to be mechanically coupled with said supporting member, said cover member covering said fixed resistor outside said chassis of said UHF tuner.

2. An antenna equipment according to claim 1, wherein said supporting member is provided with an engaging portion for engaging a groove formed in said outer wall of said chassis.

3. An antenna equipment according to claim 2, wherein said supporting member is unitarily formed with a holder portion for holding said fixed resistor, and said cover member is coupled with said holder portion.

4. An antenna equipment according to claim 1, wherein said cover member is provided with engaging portions for engaging a slot formed in said outer wall of said chassis.

5. An antenna equipment according to claim 4, wherein said cover member is unitarily formed with a receiving portion for receiving said fixed resistor.

* * * * *